US007992333B1

(12) United States Patent
McGuinness et al.

(10) Patent No.: US 7,992,333 B1
(45) Date of Patent: Aug. 9, 2011

(54) VEHICLE IDENTIFIER

(76) Inventors: Timothy McGuinness, Oakland, CA (US); James Mark Oakley Fisher, Walnut Creek, CA (US); Thomas M. Rathmann, Jr., Oakland, CA (US)

( * ) Notice: Subject to any disclaimer, the term of this patent is extended or adjusted under 35 U.S.C. 154(b) by 0 days.

(21) Appl. No.: 12/541,105

(22) Filed: Aug. 13, 2009

Related U.S. Application Data

(60) Provisional application No. 61/188,809, filed on Aug. 13, 2008.

(51) Int. Cl.
*G09F 21/04* (2006.01)

(52) U.S. Cl. ..... 40/591; D20/42; 116/28 R; 116/63 T

(58) Field of Classification Search ..... 40/591, 40/593; D20/42; D10/109; 116/28 R, 42, 116/173
See application file for complete search history.

(56) References Cited

U.S. PATENT DOCUMENTS

| | | | | |
|---|---|---|---|---|
| 3,975,849 | A * | 8/1976 | Tuleja | 40/583 |
| 4,754,565 | A * | 7/1988 | Cox | 40/591 |
| 5,195,264 | A * | 3/1993 | Johanson et al. | 40/591 |
| 5,249,381 | A * | 10/1993 | Panossian | 40/591 |
| 7,066,105 | B2 * | 6/2006 | Tal | 116/28 R |

* cited by examiner

*Primary Examiner* — Casandra Davis
(74) *Attorney, Agent, or Firm* — Peters Verny, LLP

(57) ABSTRACT

A vehicle identification device includes one or more clips configured to attach the device to a vehicle door or window. The identification device optionally includes reflective material so that the vehicle is more easily seen. The identification device optionally includes identification indicia such as letters or numbers. The identification device is optionally deployed from within the vehicle, thus improving safety.

21 Claims, 11 Drawing Sheets

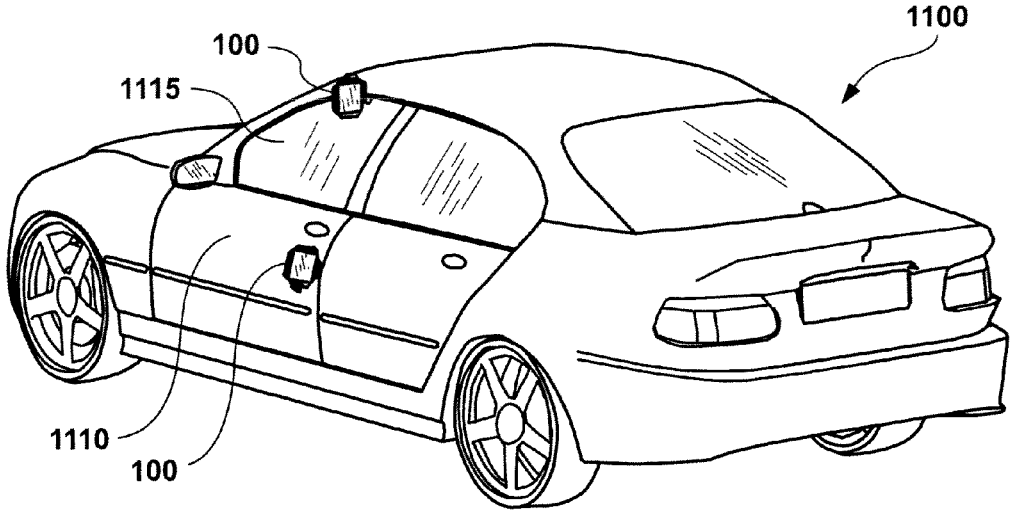
FIG. 11
FIG. 12
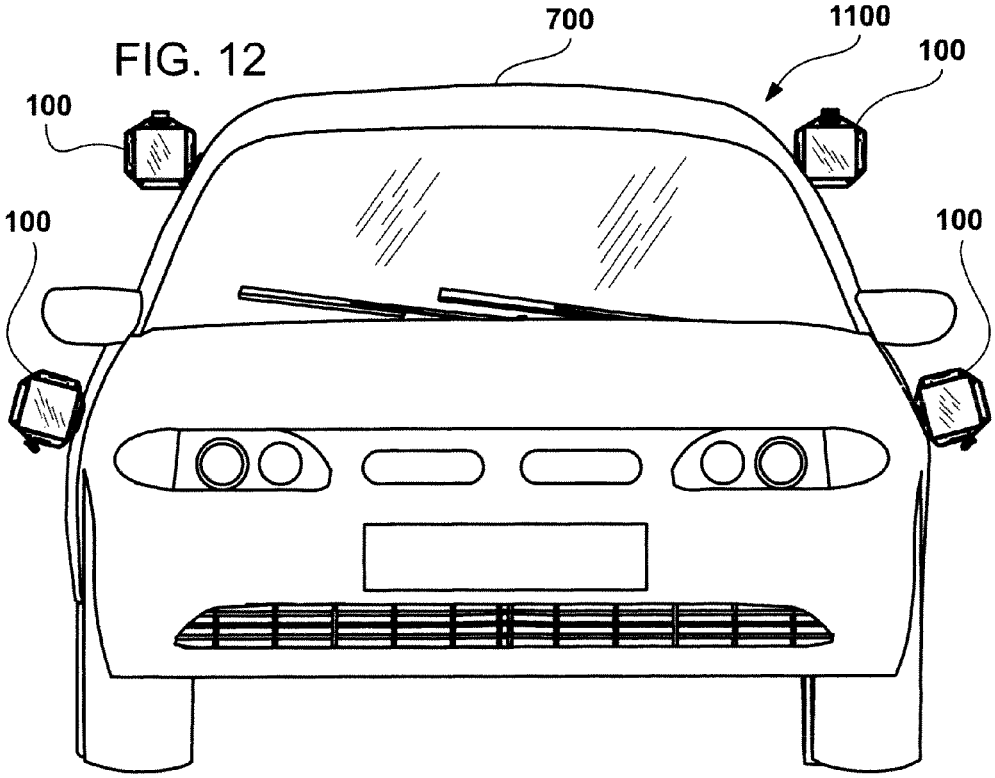

VEHICLE IDENTIFIER

CROSS-REFERENCE TO RELATED APPLICATIONS

This application claims the benefit of and priority to U.S. Provisional Patent Application Ser. No. 61/188,809 filed on Aug. 13, 2008, entitled "Auxiliary Vehicle Reflector." The disclosure of the above provisional patent application is hereby incorporated herein by reference.

BACKGROUND OF THE INVENTION

1. Field of the Invention

The present invention relates to attachable identification devices, for example, those including reflective material disposed to make a vehicle more conspicuous.

2. Related Art

Modern vehicles are equipped with various kinds of reflective devices designed for identification of the vehicle, e.g., to make the vehicle conspicuous or to differentiate one vehicle from another. Conspicuity may relate to the effective demarcation of the 'size', and or 'shape' of a vehicle whether it is moving or stationary. The need for conspicuity increases for stationary vehicles, especially those that are parked or 'stalled' in areas not designated for stationary vehicles such as near thoroughfares or roadways.

When a vehicle is parked or 'stalled' it is sometimes the practice to deploy reflective devices such as traffic cones, reflective triangles, or flares proximate to the vehicle.

SUMMARY OF THE INVENTION

Embodiments of the invention include a device configured to be attached to a vehicle such that a reflective surface of the device makes the vehicle more identifiable, e.g., conspicuous. In typical embodiments, the device includes one or more clips configured such that the reflective surface is disposed approximately perpendicular to a side of the vehicle. The one or more clips may include clips of specific orientation and shape for attachment to specific parts of a vehicle. For example, the one or more clips may include a clip configured for attachment to a window, a clip configured for attachment to a door, a clip for attachment to a mirror, or the like. The device may include any combination of such clips.

In some embodiments the device includes a clip configured to be attached to a vehicle window. This clip optionally has a material thickness that allows the window to be closed while the device is attached. The device is optionally attached to the window from the inside of the vehicle by partially rolling the window down, clipping the device to an upper edge of the window, and then rolling the window back up. This allows the device to be deployed without exiting the vehicle.

In some embodiments the device includes a clip configured to be attached to a vehicle door, e.g., a side door or a back door. This clip optionally has a material thickness and length that allows the door to be closed while the device is attached.

The device optionally includes further attachment mechanisms such as pilot holes and/or slots for straps. The device may include identification indicia such as a color, symbols, letters and/or numbers in addition to or in place of a reflective surface.

Various embodiments of the invention include an identification device comprising a first identification surface including at least identification indicia or a reflective material; at least one clip attached to the first identification surface and configured for attaching the identification device to a door or a window of a vehicle, the at least one clip being attached to the first identification surface at an angle that positions the first identification surface approximately perpendicular to a side of the vehicle when attached to the door or window. In some embodiments the identification device includes two clips at different angles relative to the identification surface.

Various embodiments of the invention include an identification device comprising a reflective surface; a first clip configured to attach the identification device to a window of a vehicle such that the reflective surface is approximately perpendicular to a side of the vehicle; and a second clip configured to attach the identification device to a door of a vehicle such that the reflective surface is approximately perpendicular to the side of the vehicle. The first and second clips are typically configured such that the door and window can be closed while the respective clip is attached.

Various embodiments of the invention include a method comprising halting a vehicle; lowering a window of the vehicle or opening a door of the vehicle; clipping an identification device including a reflective surface to the window or door while sitting in the vehicle, the reflective surface being approximately perpendicular to the window or the door; and raising the window or closing the door of the vehicle such that the identification device is disposed on the outside of the vehicle.

BRIEF DESCRIPTION OF THE DRAWINGS

FIGS. 11 and 12 illustrate attachment of identification device(s) to a vehicle door and a vehicle window, according to various embodiments of the invention.

DETAILED DESCRIPTION

There are many diverse situations in which vehicle identification is useful. For example, managing a number of vehicles may include identifying the vehicles with number, letters, or other symbols. In this type of vehicle identification a vehicle is identified so as to distinguish it from other vehicles, e.g., vehicle A is identified as being different that vehicle B. This type of vehicle identification is useful for finding a specific vehicle among many. In other examples, vehicle identification may include making a vehicle more conspicuous such that its presence and/or location is more easily discernable. Attachment of a reflective device to a vehicle is an example of this type of vehicle identification. Embodiments of the invention include identification device that may be used for either or both types of identification.

Figure 1:
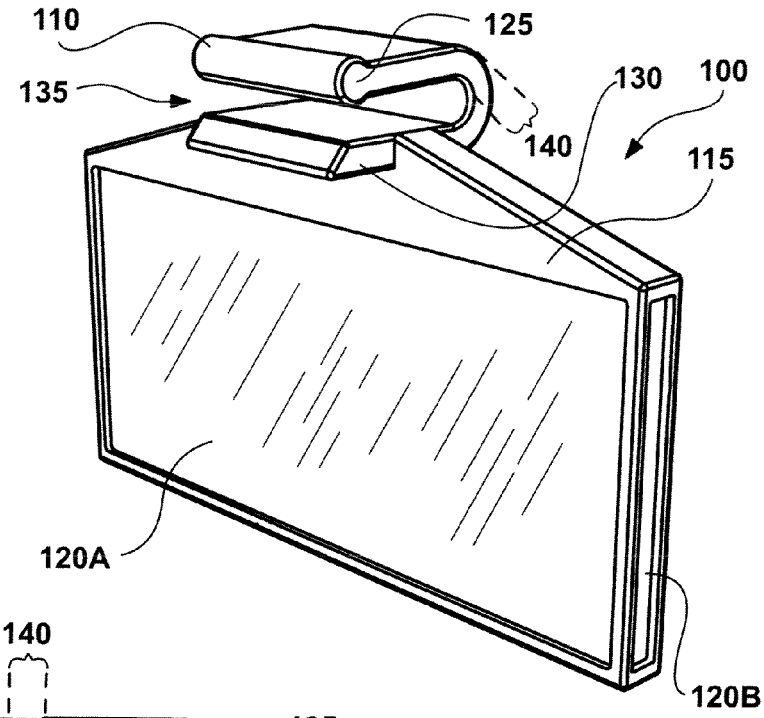
FIG. 1 is a prospective view of an identification device, according to various embodiments of the invention.

FIG. 1 is a prospective view of an Identification Device 100, according to various embodiments of the invention. Identification Device 100 includes a Clip 110, a Body 115 and one or more Identification Surface 120, individually labeled 120A, 120B, etc. Identification Device 100 is configured to be attached to a vehicle using Clip 110. For example Clip 110 may be of a size and shape appropriate for attachment to a door or window of the vehicle.

Clip 110 includes a Free End 125, a Fixed End 130 and a Slot 135 there between. The position of Clip 110 may be characterized by a plane parallel to Slot 135. In the embodiments illustrated in FIG. 1 the plane of Clip 110 is perpendicular to both Identification Surface 120A and Identification Surface 120B. When Identification Device 100 is attached to a vehicle door or window, the door or window fits into Slot 135 and is in the plane of Clip 110. Free End 125 is optionally terminated in a rounded portion. Clip 110 may be orientated as illustrated in FIG. 1 or alternatively be rotated in the plane of Clip 110. For example, in some embodiments Clip 110 is rotated approximately 90 degrees in the plane of Clip 110. In some embodiments, Clip 110 is removable from Body 115, and may be reattached to Body 115 in different orientations and, or positions. In some embodiments Clip 110 is rotatably attached to Body 115.

Clip 110 may be rubber, plastic and/or metal. For example, in some embodiments Clip 110 includes a rubber coated metal clip. In some embodiments, Clip 110 includes a molded polymer. Clip 110 may be attached to Body 115 using an adhesive, a fastener, a magnet, or the like, or may be integral to Body 115. For example, in some embodiments, Clip 110 and Body 115 are a single molded or stamped piece. The material thickness of Clip 110 is optionally thin enough to fit between a vehicle door and adjacent parts of the vehicle when the vehicle door is closed. The material thickness of Clip 110 is defined herein as the Thickness 140 of the material making up Clip 110 at the curved region where Free End 125 and Fixed End 130 meet.

The height of Slot 135, e.g., the distance across Slot 135 from Free End 125 to Fixed End 130, is typically configured to snugly fit a vehicle window or the edge of a vehicle door. As Clip 110 is normally flexible this height may change as the Identification Device 100 is attached to a vehicle.

Clip 110 is optionally configured to hold the identification device to a vehicle door or a vehicle window securely while the door or the window are closed. This attachment is secure in that Identification Device 100 cannot be removed (without breaking) while the door and window are closed. Clip 110 is held in place between the window or door and adjacent vehicle parts. For example, when a window is inserted in to Slot 135 and the window is closed, the rounded edge of Clip 110 comes in contact with those parts of the vehicle directly above the window. This prevents the Clip 110 from being pulled free of the window and requires that the window (or door) be opened to remove Identification Device 100. By locking a window or door Identification Device 100 may be locked to a vehicle.

Body 115 may include metal, rubber, plastic, or other weather resistant material, and typically includes at least one Identification Surface 120. Body 115 may be molded, stamped or otherwise formed. In some embodiments, Body 115 includes a molded polymer.

Identification Surface 120 typically includes at least identification indicia and/or a reflective material. Identification indicia may include a color, symbols, letters and/or numbers. Identification indicia may be integral to Body 115 or attached to Identification Surface 120. For example, identification indicia may comprise stickers, paint, ink, paper, dye, and/or the like. In some embodiments, Identification Surface 120 is writable or writeable/erasable. Identification Surface 120 is optionally recessed.

The reflective material is typically configured to make Identification Device 100 conspicuous, and may be integral to or attached to Identification Surface 120. In some embodiments, the reflective material may include a mirror or polished metal. In some embodiments, the reflective material is configured to reflect and scatter light. The Scotchlite™ family of products available from 3M Corporation are examples of reflective material that may be included in the invention. Reflective material is optionally included on part but not all of Identification Surface 120A. Reflective material may be included on one, two, three or more of Identification Surfaces 120.

Clip 110 is typically attached to Identification Surface 120 in an orientation and angle such that Identification Surface 120 is approximately perpendicular to the side of a vehicle when the Identification Device 100 is attached to a door or a window of the vehicle using Clip 110. As illustrated in FIG. 1 the attachment between Clip 110 and Identification Surface 120 is optionally via Body 115.

Figure 2:
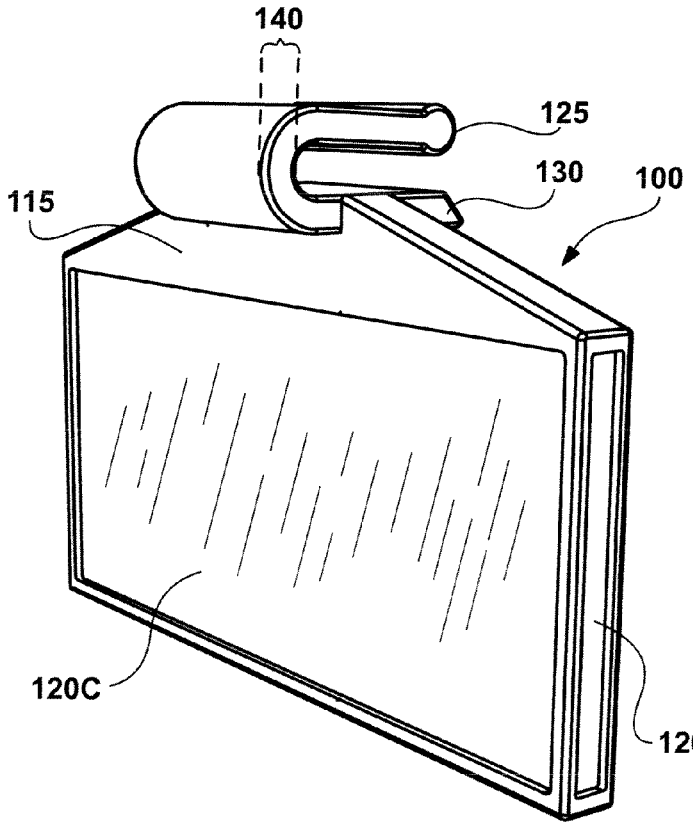
FIG. 2 is an alternative view of the identification device of FIG. 1, according to various embodiments of the invention.
Figure 3:
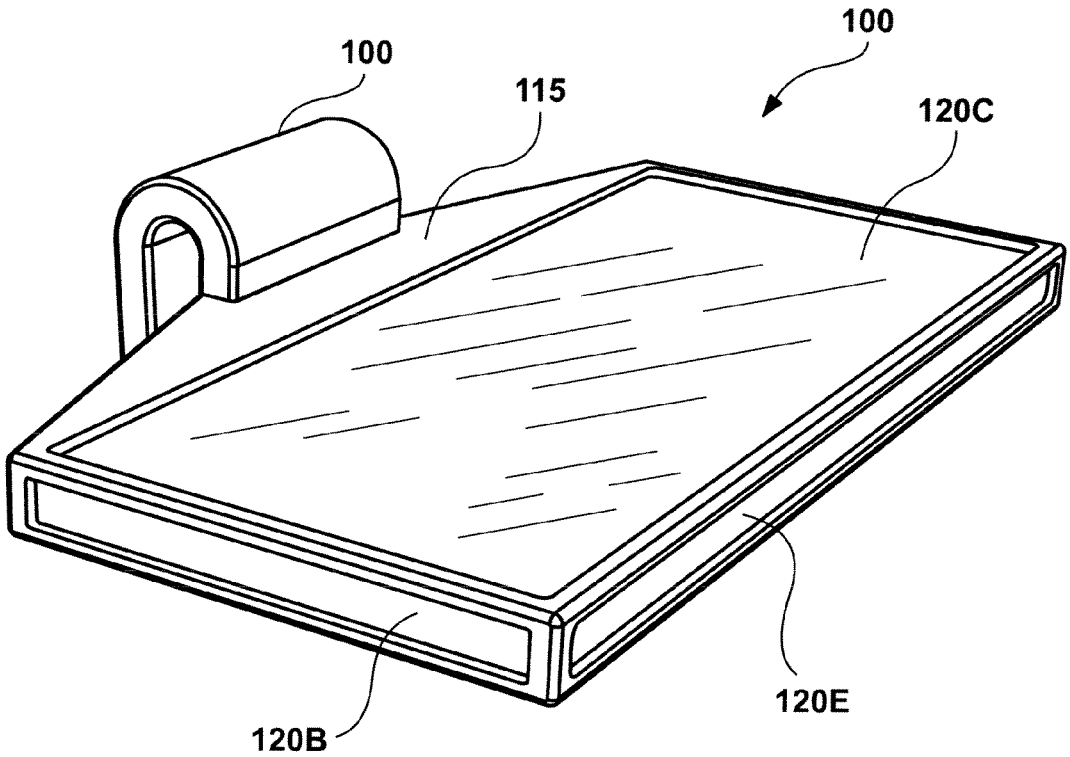
FIG. 3 is an alternative view of the identification device of FIG. 1, according to various embodiments of the invention.

FIG. 2 is an alternative view of Identification Device 100, according to various embodiments of the invention. This view shows optional Identification Surfaces 120C and 120D. FIG. 3 is an alternative view of Identification Device 100, according to various embodiments of the invention. This view shows optional Identification Surface 120E. One of Identification Surfaces 120 may include reflective material while another of Identification Surfaces 120 includes identification indicia. The identification indicia may also be reflective.

Figure 4:
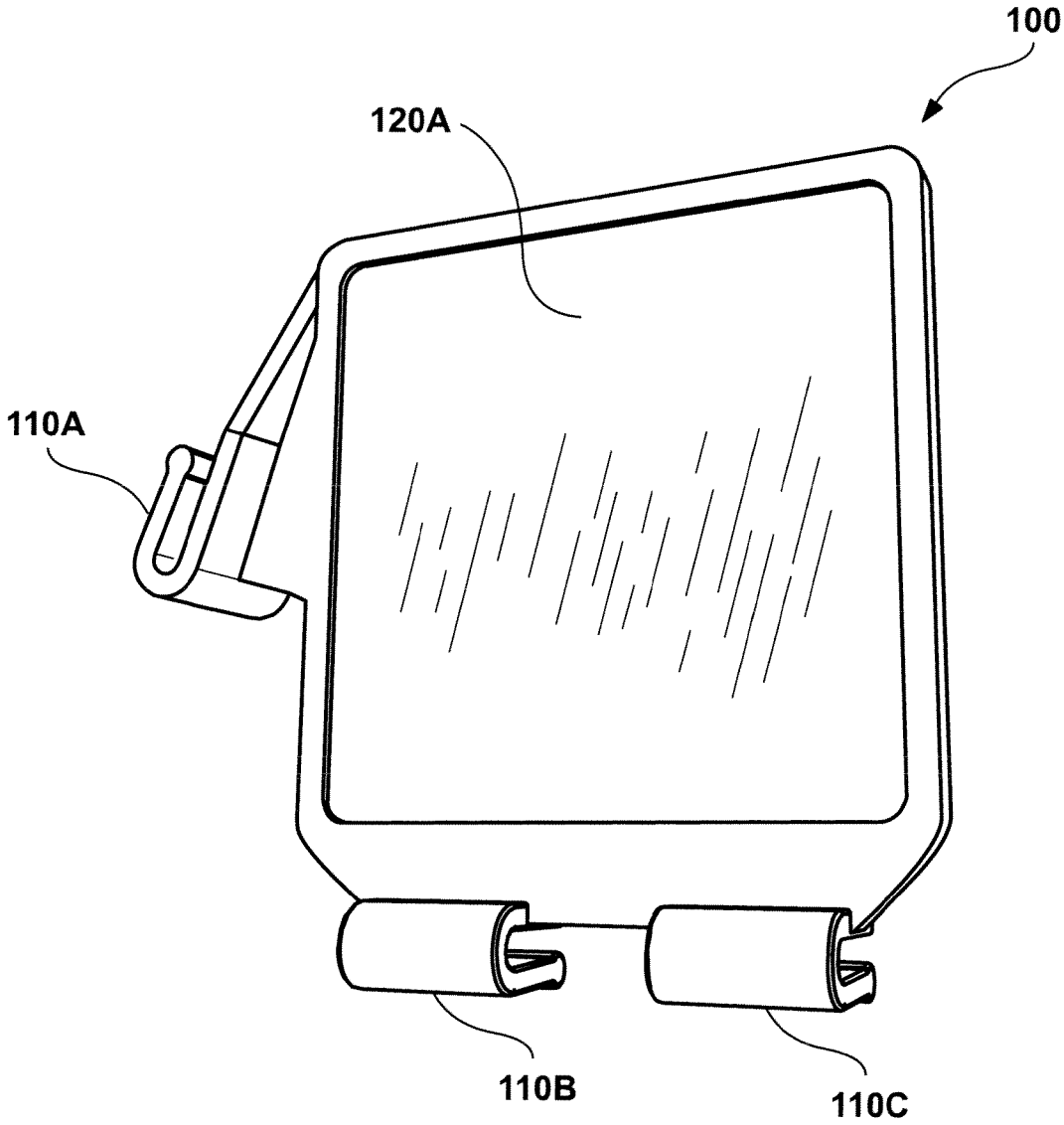
FIG. 4 illustrates alternative embodiments of the identification device of FIG. 1 including three clips.

FIG. 4 illustrates alternative embodiments of Identification Device 100 including three Clips 110, individually labeled 110A, 110B and 110C. Clip 110A is optionally a different size and/or shape than Clips 110B and 110C. For example, Clip 110A may be configured for, e.g., have a shape and dimensions for, attachment to a vehicle window while Clips 110B and 110C are configured for attachment to a vehicle door or mirror.

Figure 5:
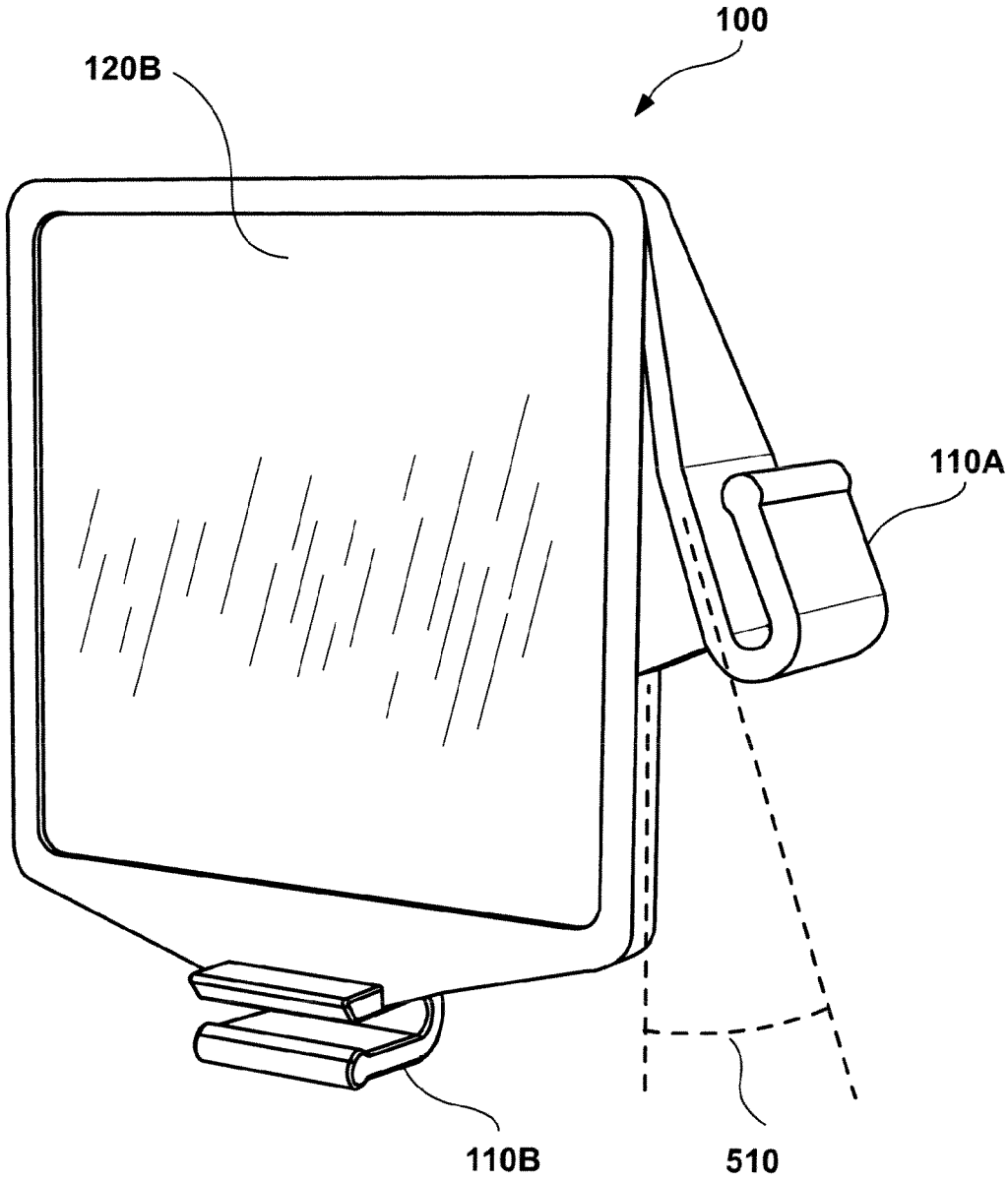
FIG. 5 illustrates alternative embodiments of the identification device of FIG. 1 including two clips.

FIG. 5 illustrates alternative embodiments of Identification Device 100 including two Clips 110A and 110B. Clip 110A is optionally disposed at an Angle 510 from the body of Identification Device 100. This angle may be configured to provide clearance for a window or door frame near the rounded portion of Clip 110A where Free End 125 and Fixed End 130 meet. This angle may be between 10 and 90 degrees.

Figure 6:
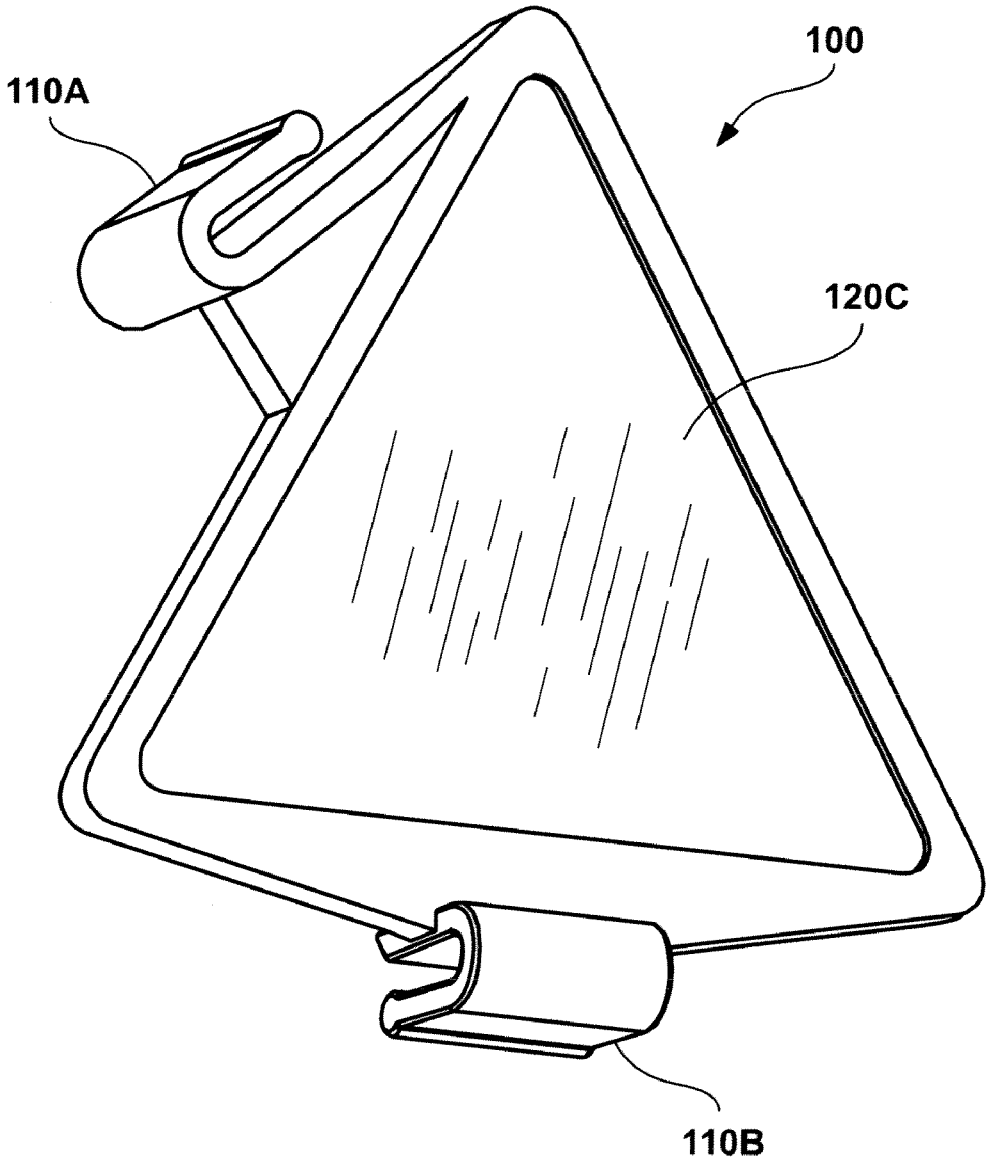
FIG. 6 illustrates alternative embodiments of the identification device of FIG. 1 including a triangular shape.
Figure 7:
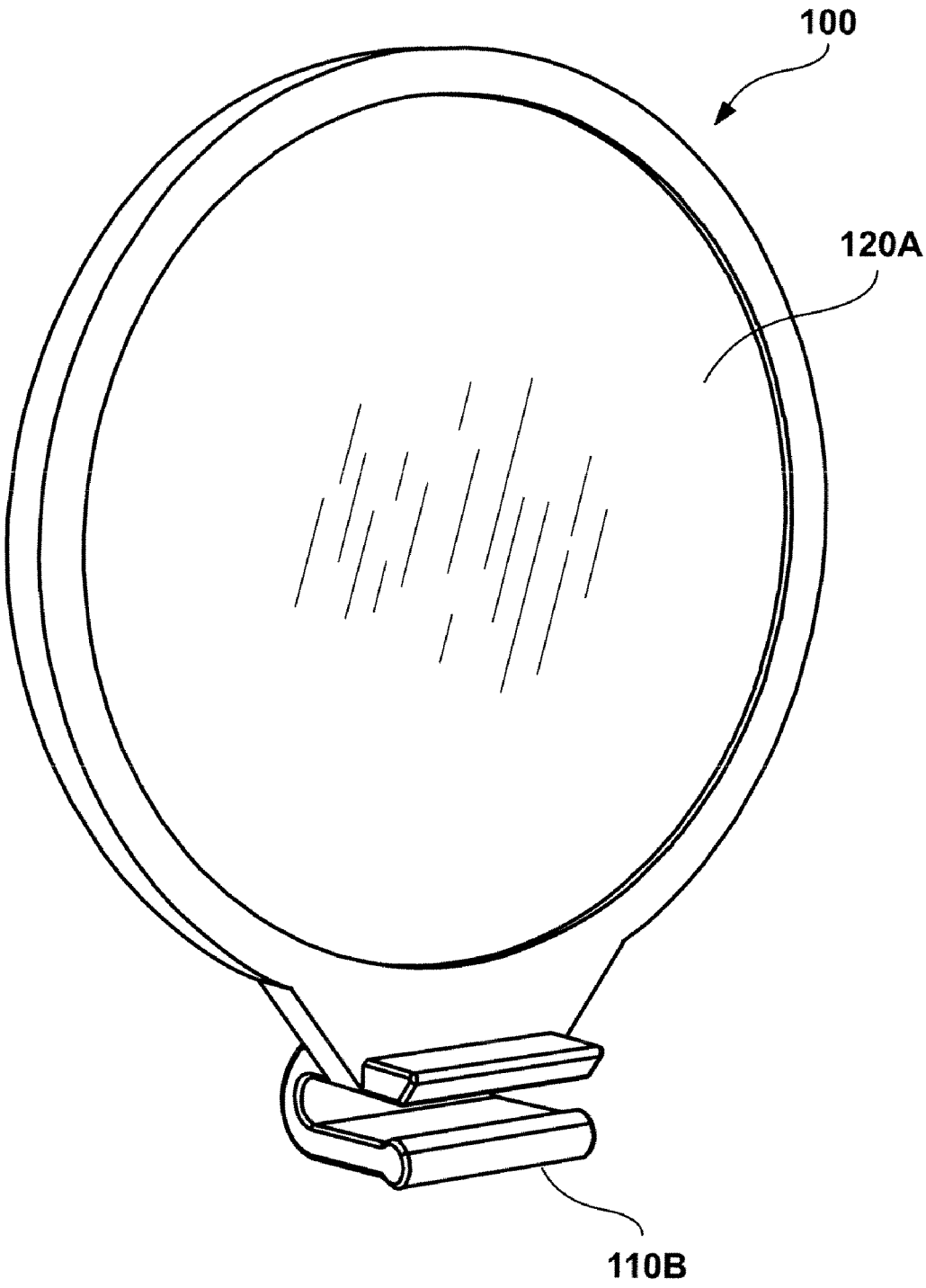
FIG. 7 illustrates alternative embodiments of the identification device of FIG. 1 including a triangular shape.

FIG. 6 illustrates alternative embodiments of Identification Device 100 including a triangular shape for Body 115. FIG. 7 illustrates alternative embodiments Identification Device 100 including a round shape for Body 115. The shape of Identification Device 100 may have meaning such as an octagonal stop sign. Body 115 may take a wide variety of shapes. For example, Body 115 may be an arrow, round, oval square, triangular, rectangular, pentagonal, hexagonal or a higher order polygon. Body 115 may be flat or curved, and is optionally flexible.

Figure 8:
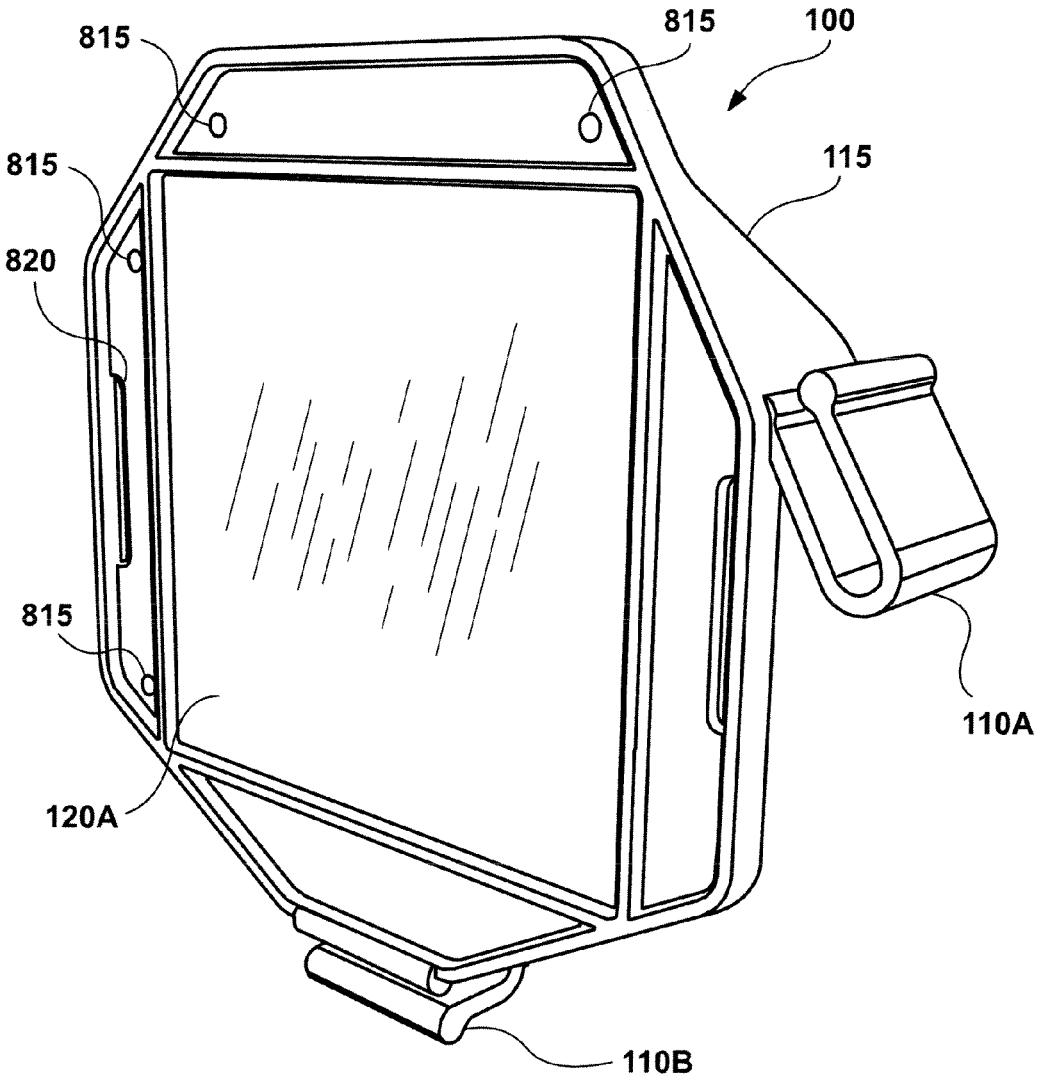
FIG. 8 is a prospective view of an alternative identification device, according to various embodiments of the invention.

FIG. 8 is a prospective view of alternative embodiments of Identification Device 100. These embodiments include a first Clip 110A and a second Clip 110B configured for attachment to a window and a door of a vehicle, respectively. Identification Surface 120A and/or Identification Surface 120C are approximately perpendicular to a side of a vehicle when Clip 110A is used to attach Identification Device 100 to a vehicle window. Likewise, Identification Surface 120A and/or Identification Surface 120C are approximately perpendicular to a side of a vehicle when Clip 110B is used to attach Identification Device 100 to a vehicle door.

Clip 110A and Clip 110B optionally have different characteristics. For example, they may be disposed at different angles relative to Identification Surface 120A, have different material thicknesses, and/or be different sizes. In the embodiments illustrated in FIG. 8, a plane of Clip 110A and a plane of Clip 110B are both perpendicular to Identification Surface 120A. However, the plane of Clip 110A and the plane of Clip 110B intersect at an acute angle. In various embodiments, this intersection angle is between 10 and 80 degrees, between 45 and 75 degrees, or approximately 60 degrees. Because the planes of Clip 110A and Clip 110B are both perpendicular to Identification Surface 120A their intersection forms a line that is approximately perpendicular to Identification Surface 120A. In some embodiments Clip 110B is smaller and/or has a smaller material thickness relative to Clip 110A. Clip 110A and 110B may also have different depths of Slot 135. These smaller dimensions sometimes allow Clip 110B to fit between a closed vehicle door and adjacent vehicle parts.

Figure 9:
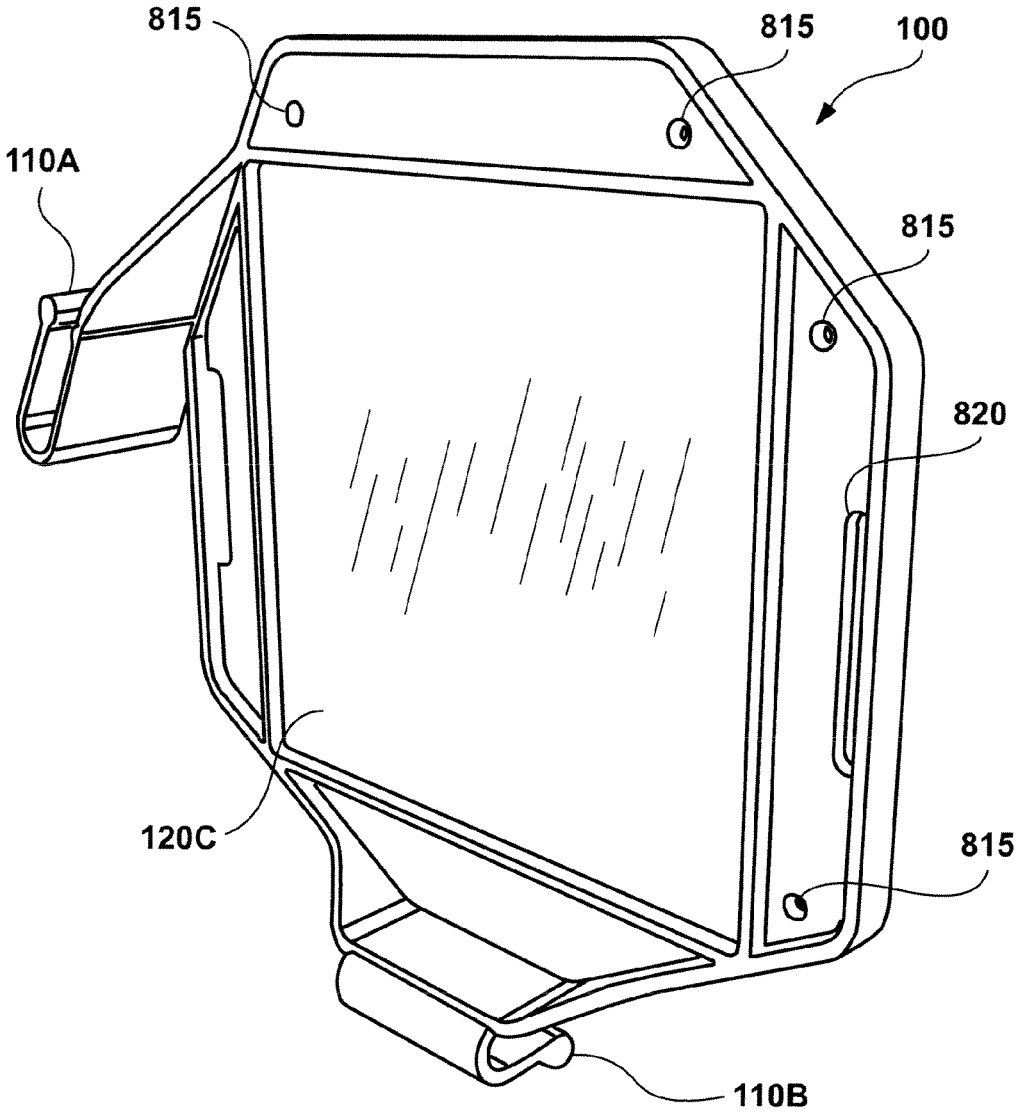
FIG. 9 is an alternative view of the identification device of FIG. 8, according to various embodiments of the invention.

FIG. 9 is an alternative view of the embodiments of Identification Device 100 illustrated by FIG. 8. This view illustrates that Clips 110A and 110B are optionally disposed predominately on one side of Identification Device 100. Specifically, Clips 110A and 110B are disposed on the same side as Identification Surface 120C. The embodiments of Identification Device 100 illustrated in FIGS. 4 and 5 may have one, two or more Identification Surfaces 120.

Figure 10:
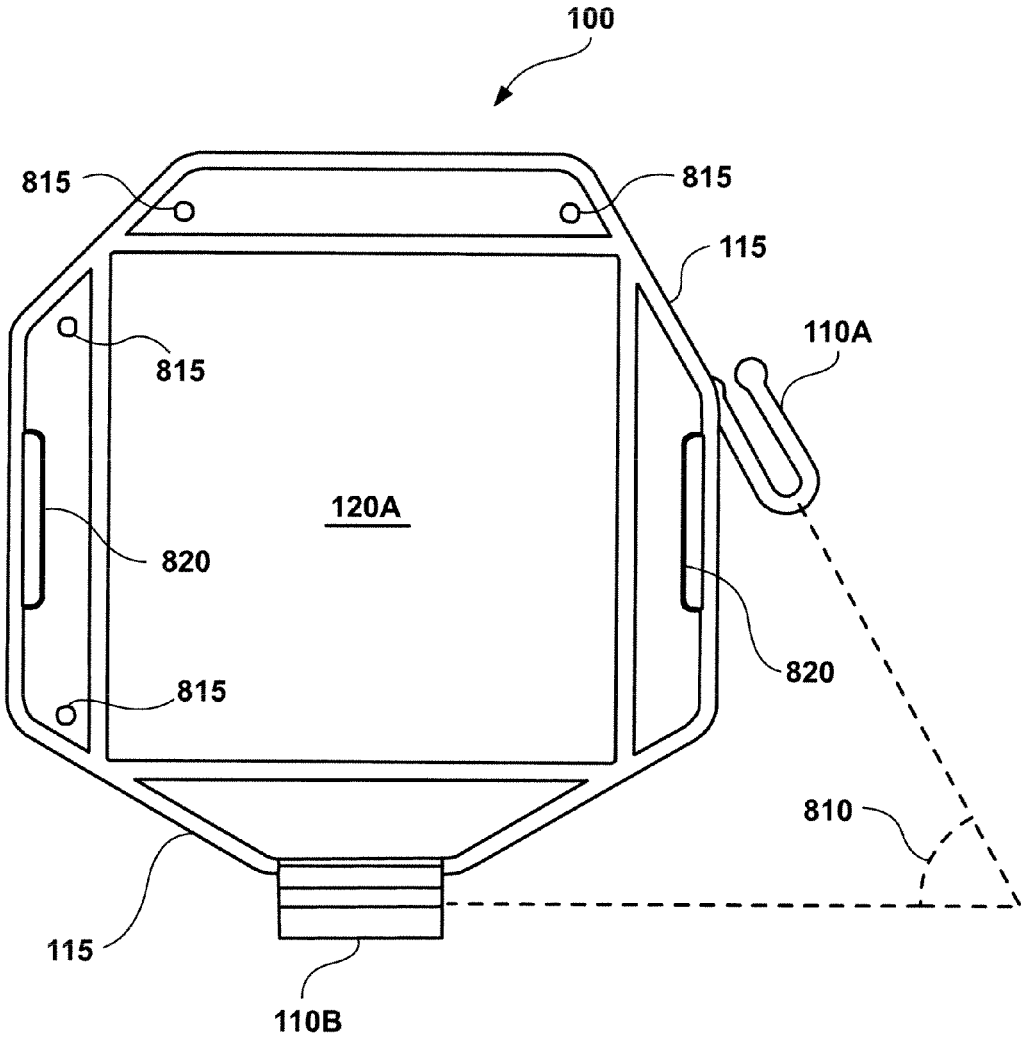
FIG. 10 is an alternative view of the identification device of FIG. 8, according to various embodiments of the invention.

FIG. 10 is an alternative view of the embodiments of Identification Device 100 illustrated by FIG. 8. This view shows the intersection angle 810 between the planes of Clip 110A and Clip 110B. This view also shows several alternative attachment mechanisms including Pilot Holes 815 and Slots 820. Pilot Holes 815 are configured for nailing or screwing Identification Device 100 to an object. This object may be something other than a vehicle. Slots 820 are configured to receive a strap or cord for attaching Identification Device 100 to an object. For example, Identification Device 100 may include straps that loop though Slots 820 and can be used to attach Identification Device 100 to an object, such as a vehicle side mirror. In some embodiments, Slots 820 are at least ¼ inches in length. In various embodiments the dimensions of Identification Surface 120A are between 4 cm and 20 cm in width, and between 4 cm and 20 cm in height. Larger dimensions are included in alternative embodiments. In one example, Identification Surface 120A is approximately 8 cm square and is surrounded by adjacent regions of Body 115 configured to support Clip 110A and/or Clip 110B. In various embodiments Body 115 is between 1 mm and 10 mm thick.

FIGS. 11 and 12 illustrate attachment of Identification Devices 100 to a Vehicle Door 1110 and a Vehicle Window 1115 of a Vehicle 1100, according to various embodiments of the invention. When attached using the appropriate Clip 110, Identification Surface 120 of Identification Device 100 will be disposed approximately perpendicular to the sides of Vehicle 1100. As used herein, the "sides" of Vehicle 1100 is meant to refer to the right and left sides, and not front and back ends, or top and bottom. Identification Device 100 may be attached to other parts of Vehicle 1100 such as a trunk, hood, sunroof, antenna, bumper, hubcap, license plate, door handle, etc. As illustrated in FIG. 12, Identification Device 100 may be attached on either left or right sides of Vehicle 1100.

Figure 13:
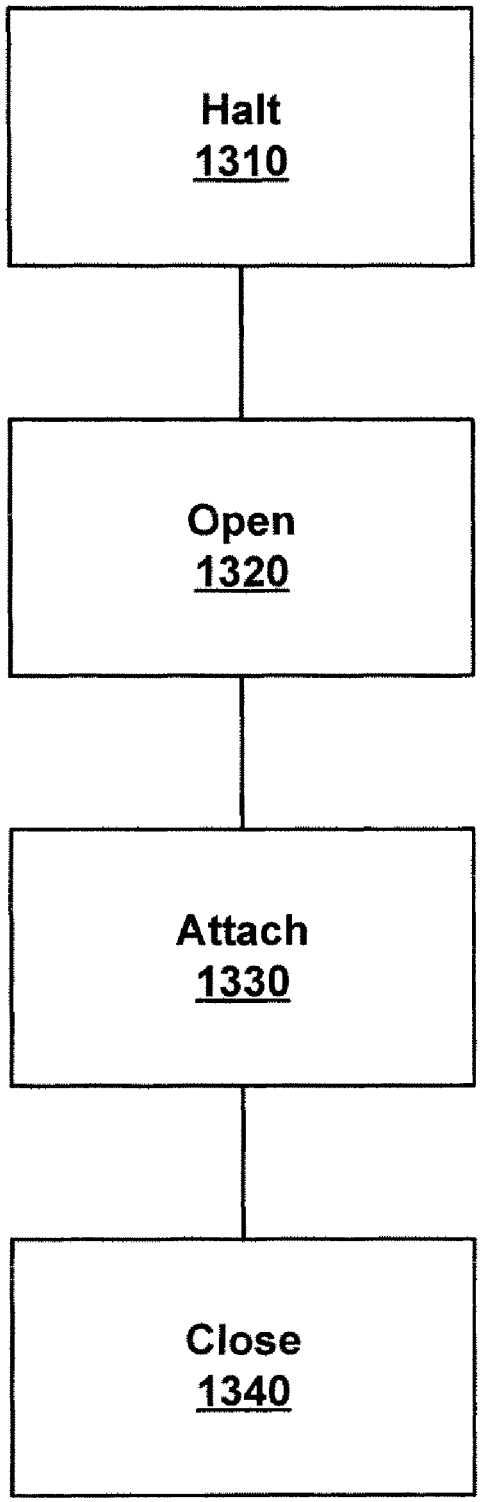
FIG. 13 illustrates a method according to various embodiments of the invention.

FIG. 13 illustrates a method according to various embodiments of the invention. This method comprises an optional Halt Step 1310 in which a vehicle is halted. An Open Step 1320 in which a window of the vehicle is lowered (opened) or a door of the vehicle is opened. An Attach Step 1330 in which Identification Device 100 is attached to the window or door; and a Close Step 1340 the window or door are closed. The steps of FIG. 13 are optionally performed from inside the vehicle, e.g., without leaving the vehicle.

Several embodiments are specifically illustrated and/or described herein. However, it will be appreciated that modifications and variations are covered by the above teachings and within the scope of the appended claims without departing from the spirit and intended scope thereof. For example, Identification Device 100 may include a radio frequency identification (RFID) tag, a light source (e.g., light emitting diode), and/or a power source. The power source may include a solar cell, a battery, or a plug compatible with vehicle electronics. In some embodiments, Clip 110 includes electrical conductors configured to pass electrical power between the interior and exterior of a vehicle. In these embodiments, a "cigarette lighter" plug and electrical conductors may be used to convey power from the interior of a vehicle to a light source disposed with Identification Device 100 attached to the exterior of the vehicle. Identification Device 100 is optionally attached to a vehicle or other object using an adhesive.

The embodiments discussed herein are illustrative of the present invention. As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. An identification device comprising:

A first reflective surface;

a first clip disposed on a first edge of the reflective surface and configured to attach the identification device to an approximately horizontal edge of window of a vehicle such that the reflective surface is approximately perpendicular to a side of the vehicle; and a second clip disposed on a second edge of the reflective surface and configured to attach the identification device to an approximately horizontal edge of door of a vehicle such that the reflective surface is approximately perpendicular to the side of the vehicle.

2. The identification device of claim 1, wherein the first reflective surface includes identification indicia.

3. The identification device of claim 1, further comprising a second reflective surface on a side of the identification device opposing the first reflective surface.

4. The identification device of claim 3, wherein the second reflective surface comprises identification indicia including a letter or a number.

5. The identification device of claim 1, wherein the identification device includes pilot holes.

6. The identification device of claim 1, wherein the identification device includes a slot at least ¼ inches in length.

7. The identification device of claim 1, wherein the identification device further comprises a molded polymer.

8. The identification device of claim 1, wherein the first clip includes a molded polymer.

9. The identification device of claim 1, wherein the first clip and the second clip are part of a single molded piece.

10. The identification device of claim 1, wherein the first clip and the second clip are configured to hold the identification device to the door or the window securely while the door or the window are closed, the secure attachment requiring that the door or the window be opened to remove the identification device.

11. The identification device of claim 1, further comprising a writing surface attached to the first clip.

12. The identification device of claim 1, wherein the first clip and the second clip are disposed at different angles relative to the reflective surface.

13. The identification device of claim 1, wherein a plane of the first clip and a plane of the second clip are characterized by an intersection angle between 10 and 80 degrees.

14. The identification device of claim 1, wherein a plane of the first clip and a plane of the second clip are characterized by an intersection angle between 45 and 75 degrees.

15. The identification device of claim 1, wherein a plane of the first clip and a plane of the second clip intersect in a line approximately perpendicular to the reflective surface.

16. The system of claim 1, wherein the second clip is configured to receive the door in a direction parallel to a plane of the first clip.

17. The system of claim 1, wherein the second clip is further configured such that the reflective surface is approximately vertical when the identification device is attached to a side edge of the door.

18. The identification device of claim 1, wherein the first clip has a larger material thickness than the second clip.

19. An identification device comprising:

a first reflective surface;

a first clip configured to attach the identification device to a window of a vehicle such that the reflective surface is approximately perpendicular to a side of the vehicle; and a second clip configured to attach the identification device to a door of a vehicle such that the reflective surface is approximately perpendicular to the side of the vehicle, wherein the first clip and the second clip are of different sizes.

20. An identification device comprising:

a first reflective surface; a first clip configured to attach the identification device to a window of a vehicle such that the reflective surface is approximately perpendicular to a side of the vehicle; and a second clip configured to attach the identification device to a door of a vehicle such that the reflective surface is approximately perpendicular to the side of the vehicle, wherein the first clip and the second clip are disposed predominately on one side of a plane of the reflective surface.

21. An identification device comprising:

a first reflective surface;

a first clip configured to attach the identification device to a window of a vehicle such that the reflective surface is a approximately perpendicular to a side of the vehicle; and a second clip configured to attach the identification device to a door of a vehicle such that the reflective surface is approximately perpendicular to the side of the vehicle, wherein the first clip has a smaller material thickness than the second clip.

* * * * *